US006295436B1

(12) United States Patent
Morganti et al.

(10) Patent No.: US 6,295,436 B1
(45) Date of Patent: Sep. 25, 2001

(54) INSTALLATION OF LOWER SKIVE PLATE IN THE FUSER SECTION OF AN ELECTROPHOTOGRAPHIC MACHINE

(75) Inventors: Terry N. Morganti, Brockport; James V. Orchard, II, Holley, both of NY (US)

(73) Assignee: Heidelberg Digital L.L.C., Rochester, NY (US)

( * ) Notice: Subject to any disclaimer, the term of this patent is extended or adjusted under 35 U.S.C. 154(b) by 0 days.

(21) Appl. No.: 09/671,712

(22) Filed: Sep. 27, 2000

(51) Int. Cl.[7] ..... G03G 15/20
(52) U.S. Cl. ..... 399/323; 399/122
(58) Field of Search ..... 219/216; 271/307; 399/122, 322, 323, 22, 400

(56) References Cited

U.S. PATENT DOCUMENTS 4,475,804 * 10/1984 Kanno et al. ..... 399/323
5,532,810 * 7/1996 Cahill ..... 399/323
5,708,946 * 1/1998 Cahill et al. ..... 399/323

* cited by examiner

*Primary Examiner*—Robert Beatty
*Assistant Examiner*—Hoang Ngo

(57) ABSTRACT

A fuser section for an electrophotographic apparatus which includes a lower skive plate which can be quickly installed and removed without damaging the fuser roller. The skive plate carries a plurality of skives which strip a sheet of paper from the fuser roller during operation of the apparatus. To install the skive plate, forward latch pins are positioned in guide tracks on the fuser section and the plate is moved forward and downward while maintaining the plate in a substantially horizontal position thereby keeping the sharp skives clear of the fuser roller during installation. As the skives approach the fuser roller, rear latch pins on said skive plate are first latched to the fuser section after which the forward latch pins are latched thereto with the skives now riding on said fuser roller. To remove the skive plate, this procedure is reversed.

13 Claims, 3 Drawing Sheets

INSTALLATION OF LOWER SKIVE PLATE IN THE FUSER SECTION OF AN ELECTROPHOTOGRAPHIC MACHINE

FIELD OF THE INVENTION

The present invention relates to the installation of the lower skive plate in the fuser section of a electrophotographic copier/printer apparatus and in one of its aspects relates to an assembly for removing and replacing the lower skive plate of the fuser section of an electrophotographic apparatus whereby the assembly prevents the blades on the skive plate from cutting or digging into the pressure roller of the fuser section while the lower skive plate is being installed.

BACKGROUND OF THE INVENTION

In a typical electrophotographic machine (e.g. copier, duplicators, printers, etc.), a continuous loop of photoconductor film is commonly used to transfer an image from an input section onto a receiving medium (e.g. a sheet of paper). The film is initially charged and then passes through an input section where an image (i.e. analog or digital) is projected onto the charged film. The film then moves through a developing section where a toner is applied to the charged image, and on through an image transfer section where the image is transferred to the sheet of paper or other medium. The paper is subsequently passed through a fuser section where the toner forming the image is fixed to the paper by elevated temperature and pressure. This is typically accomplished by passing the paper between two, opposed rollers in the fuser section, i.e. a pressure roller and a fuser roller, one of which is heated.

In fuser sections such as described above, the nip between the pressure and fuser rollers is very tight. To insure that the paper will continue on through this gap and not stick to one of the rollers, "skive plates" (i.e. upper and lower skive plates) are normally provided to strip the paper off the rollers (i.e. fuser and pressure rollers, respectively) after the toner is fused onto the paper. Each plate carries a plurality of thin, extremely sharp "skives" (i.e. blades) (e.g. 0.004 inches thick) which effectively ride on its respective roller. These plates are rigidly mounted near the rollers at a precise location and angle to provide the proper stripping force without digging or gouging into the roller. As will be appreciated in this art, during assembly and service of the electrophotographic machine, the skive plates are frequently removed and then reinstalled. During this operation, the skive plate must be guided so that the sharp skives do not gouge the roller.

In known, prior art machines of this type, the installation of such skive plates present a number of problems to a service technician. First, there is nothing in the fuser section which prevents the skives from touching and possibly damaging the rollers during while the skive plate is being removed/installed. Further, there is no "fool-proof" procedure to be followed during the removal/installation of the skive plates. That is, the lower skive plate is not installed by a single straight, in-and-out movement but requires some manual adjustment before it is secured in its final operable position. A competent technician can be trained to follow the exact motions required to prevent contact between the skives and the roller but the possibility of human error is always present in operations of this type.

Still further, a cooling grill, which is used for cooling the paper as it comes off the rollers, is an integral part of the lower skive plate in prior art machines of this type and is coupled to the cooling air duct by a gasket which exerts a high frictional force on the underside of the lower skive plate. This frictional contact with the gasket makes it difficult to slide the lower skive plate smoothly out of and into its operable position.

Accordingly, those skilled in this art will recognize the need of simplifying the installation of the skive plates in the fuser section of an electrophotographic machine and making such installation effectively "fool-proof" to prevent the accidental gouging of the pressure and fuser rollers during the installation. Further, this fool-proof removal/installation procedure should be capable of being carried out by any trained technician without the need of special tools.

SUMMARY OF THE INVENTION

The present invention provides a fuser section for an electrophotographic apparatus which includes a lower skive plate which, in turn, can be easily and quickly installed in and removed from within the fuser section without the risk of accidentally damaging the fuser roller and the method for installing the skive plate in the fuser section. The lower skive plate has a plurality of skives (i.e. sharp blade-like elements) thereon which are designed to ride on a fuser roller in the fuser section and strip sheets of paper off the fuser roller as they pass thereover. Also, the skive plate has a forward and a rear latch pin on each side thereof.

To install the skive plate, the plate is positioned within the housing of the fuser section so that the plate is above the fuser roller in a substantially horizontal position. The forward latch pins are positioned into respective guide tracks of a guide assembly on the fuser section. Next, the skive plate is moved forward and downward (preferably at about a 45° angle) toward said fuser roller while keeping the plate in a relative horizontal position. This positioning keeps the skives clear of said fuser roller as the plate is being installed.

As the skives on the skive plate approach the fuser roller, the rear latch pins on said skive plate are latched to the fuser section by releasable, spring-biased rear detents therein. It is important that the rear pins are latched in the fuser section before the forward latch pins are latched which further insures that the technician installing the plate will not inadvertently tip the plate forward whereupon the sharp skives could contact and seriously damage the fuser roller. The front on the skive plate is then moved down through the remaining short distance to latch the forward latch pins in the releasable, spring-biased forward detents in the housing thereby securing said skive plate in said fuser section in its operable position with the skives now riding on said fuser roller. To remove the skive plate, the procedure is merely reversed. By releasing and raising the front of the skive plate first, the danger of the skives gouging into the fuser roller is eliminated.

Further, to simplify the installation and removal of the skive plate, the fuser section of present invention includes a cooling grill which is fixed within the housing adjacent the downstream side of the fuser roller. The present skive plate has a recess across a portion of the rear thereof which is adapted to lie over the cooling grill when the skive plate is in its operable position within the housing to thereby allow air from said cooling grill to flow through the skive plate to cool the sheets of paper as they pass over the skive plate. This eliminates the need for perforating a section of the skive plate and then frictionally coupling the plate to a source of cooling air which was required in known fuser sections of this type.

Brief Description of the Drawings

The actual construction operation, and apparent advantages of the present invention will be better understood by referring to the drawings, not necessarily to scale, in which like numerals identify like parts and in which.

DESCRIPTION OF THE PREFERRED EMBODIMENTS

Figure 1:
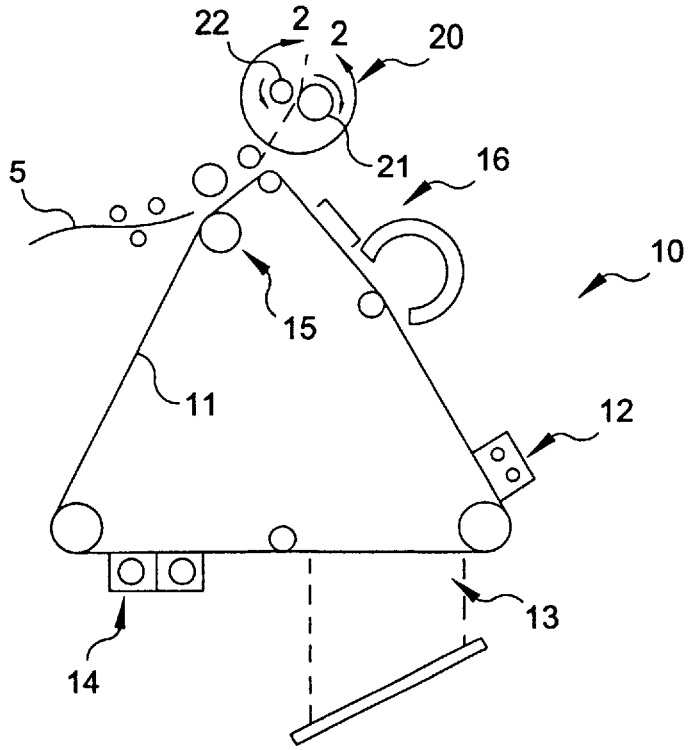
FIG. 1 is a schematic view of an electrophotographic apparatus (e.g. copier/printer machine) in which the present invention can,be incorporated.

Referring briefly to FIG. 1, a typical electrophotographic apparatus or machine 10 (e.g. copier, duplicator, printer) of the kind that has an endless photoconductor member 11 (e.g. photographic film) which moves through a closed loop past a charging station 12, a an exposure or input station 13, a developing station 14, a transfer station 14, and an erase/clean section 16. A copy medium (e.g. a sheet S of paper) is fed from a supply (not shown) through transfer station 15 where the toner image on the film 11 is transferred to the paper S. The paper S is then fed between a fusing roller 21 and a pressure roller 22 in fuser section 20 to fix the toner image on the paper S before the paper exits the machine.

Figure 2:
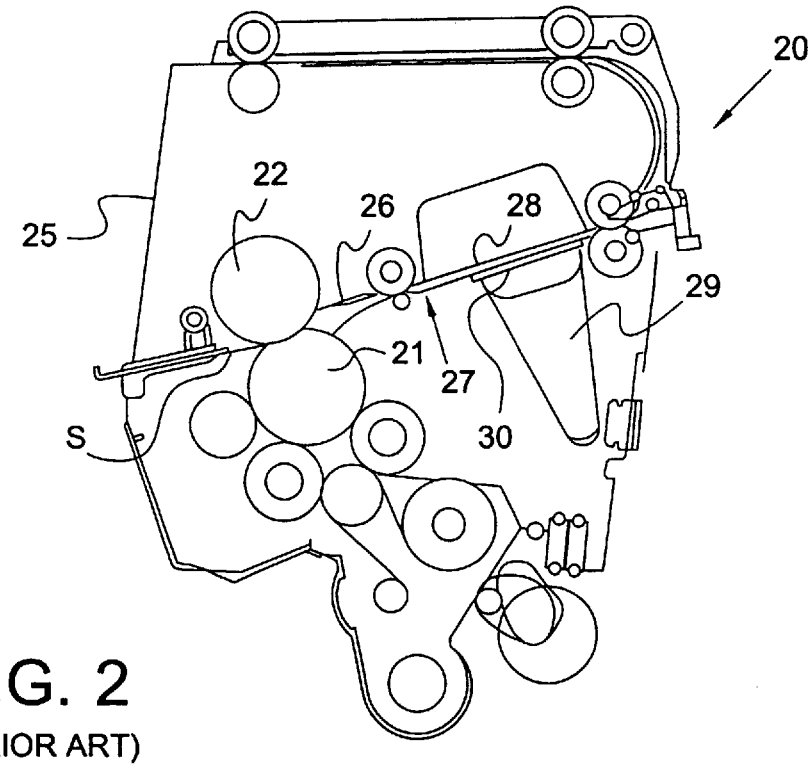
FIG. 2 (PRIOR ART)
FIG. 2 is a simplified, sectional view of the fuser section lying within line 2—2 of FIG. 1 showing prior art skive plates mounted in an operable position.

FIG. 2 is a simplified, sectional view of a typical, prior art fuser section 20*a* of the type found in a electrophotographic machine 10 such as that illustrated in FIG. 1. As illustrated, fuser section 20*a* is comprised of a frame or housing 25 in which pressure roller 21 and fuser roller 22 are rotatably mounted. An upper skive plate 26 and a lower skive plate 27 carry a plurality of skives (unnumbered) which, in turn, are positioned to effectively ride on pressure roller 21 and fuser roller 22, respectively. These skives are thin blades (e.g. 0.004 inch thick) and are extremely sharp and are designed to strip the paper S from the respective rollers as the paper passes therethrough.

Lower skive plate 27 of the prior art fuser section 20*a* has a grill-like, perforated portion 28 through which cooling air flows to cool paper S as it exits from the heated fuser roller 22. The lower side of the grill-like portion 28 is coupled to a cooling air, supply duct 29 by means of a sliding, frictional fit with gasket 30. Lower plate 27 is removed by moving the plate towards the nip between rollers 21, 22 to move a slot on the rear of the plate off a pin to release the plate and then pulling it in the other direction across the top of gasket 30. Plate 27 is installed in the same manner but using reverse steps.

The frictional contact between the gasket 30 and plate 27 makes it difficult to keep the movements of plate 27 smooth and controlled during the removal and/or installation of the lower skive plate. Also, this procedure is risky since it requires a technician to manipulate plate 27 in such a manner that there is always the possibility, if not the probability, that the sharp skives will contact the fuser roller 22, thereby causing severe damage to the roller. It is the elimination of these risks that the present invention is directed.

Figure 4:
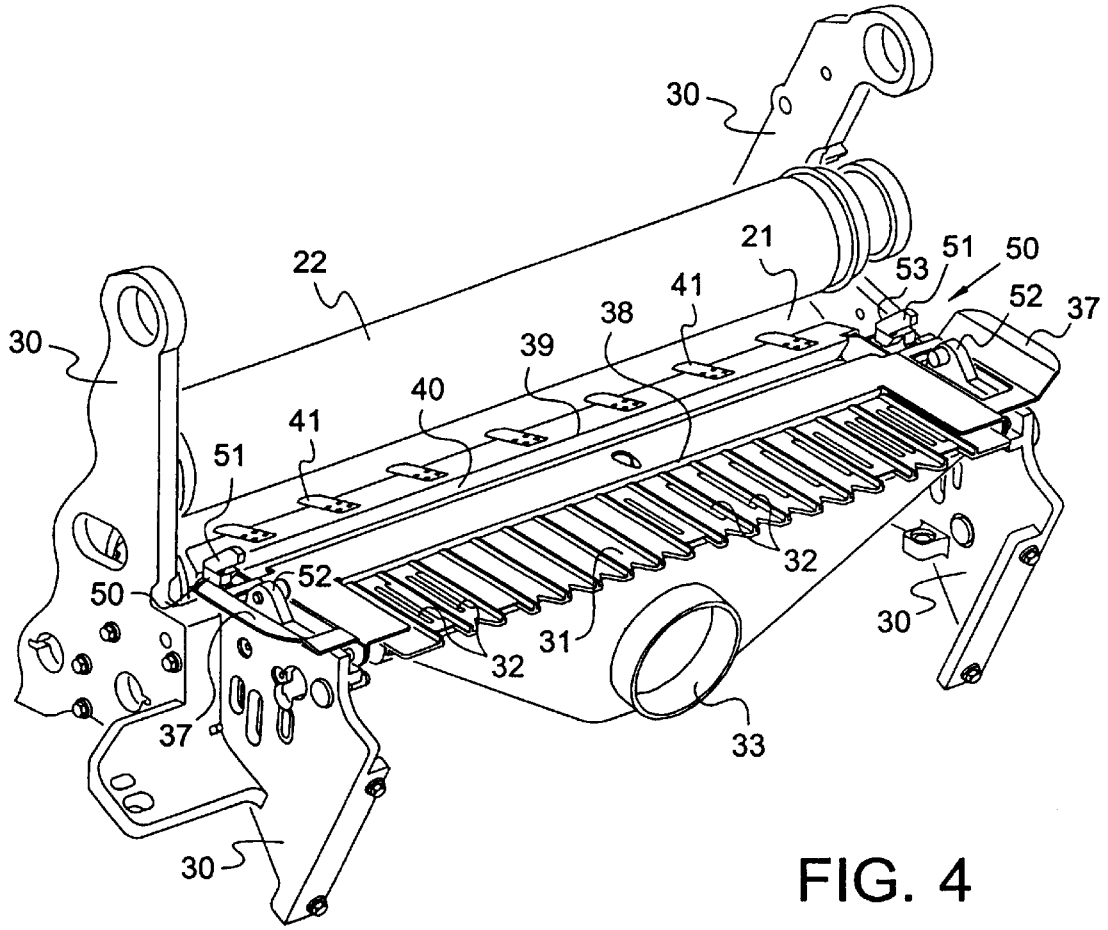
FIG. 4 is a perspective view of a portion of the fuser section of the present invention with the lower skive plate of FIG. 3 installed therein.

Turning now to the present invention, FIG. 4 illustrates a portion of the present fuser section of an electrophotographic machine with some components removed for clarity. As shown, fuser section 20 of the present invention is comprised of a frame 30 in which pressure roller 21 and fuser roller 22 are mounted for rotation. A cooling grid 31 is mounted in the frame 30 downstream from rollers 21, 22 and has a plurality of openings 32 (only some numbered for clarity) for the distribution of cooling air over the lower side of a sheet of paper (not shown) after the paper has passed through the nip between the fuser (i.e. heated) roller 21 and the pressure roller 22. Cooling air is fed to grid 31 through inlet 33 which, in turn, is connected to an air source by a conduit (not shown).

Lower skive plate 35 is positioned and secured in housing 30 as shown in FIG. 4. Lower skive plate 35 is comprised of a base plate 36 having handles 37 at either end thereof. An elongated recess 38 is provided along a portion of the rear of base plate 36 which aligns with grid 31 to allow cooling air to contact the sheet of heated paper as it exits rollers 21, 22 and skive plate 35 when the lower skive plate is in its latched, operable position (FIG. 4). Base plate 36 also has an elongated slot 39 which extends substantially across the width thereof and which is adapted to receive decurler roller 40 (FIG. 4) when lower skive plate is in its operable position.

Figure 3:
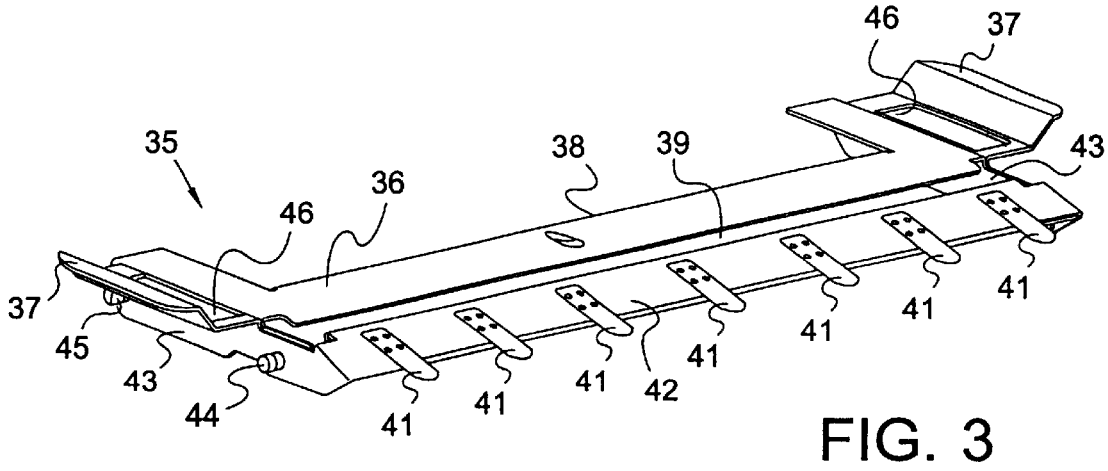
FIG. 3 is a perspective view of the lower skive plate of the present invention.

The forward portion 42 of base plate 36 is angled downward at an acute angle (e.g. about 35° ) and carries one or more spaced skives 41 (seven shown). Skives 41 are thin (e.g. 0.004 inches) blade-like members which are very sharp and which are adapted to strip a sheet of paper off fuser roller 21 and thereby keep it from sticking thereto. Base plate 35 has a downward extending side 43 at either end thereof, each of which carry a forward pin 44 and a rear pin 45 (only one side shown in FIG. 3). A substantially rectangular opening 46 is provided in each of the handles 37 for a purpose to be described later.

Figure 5:
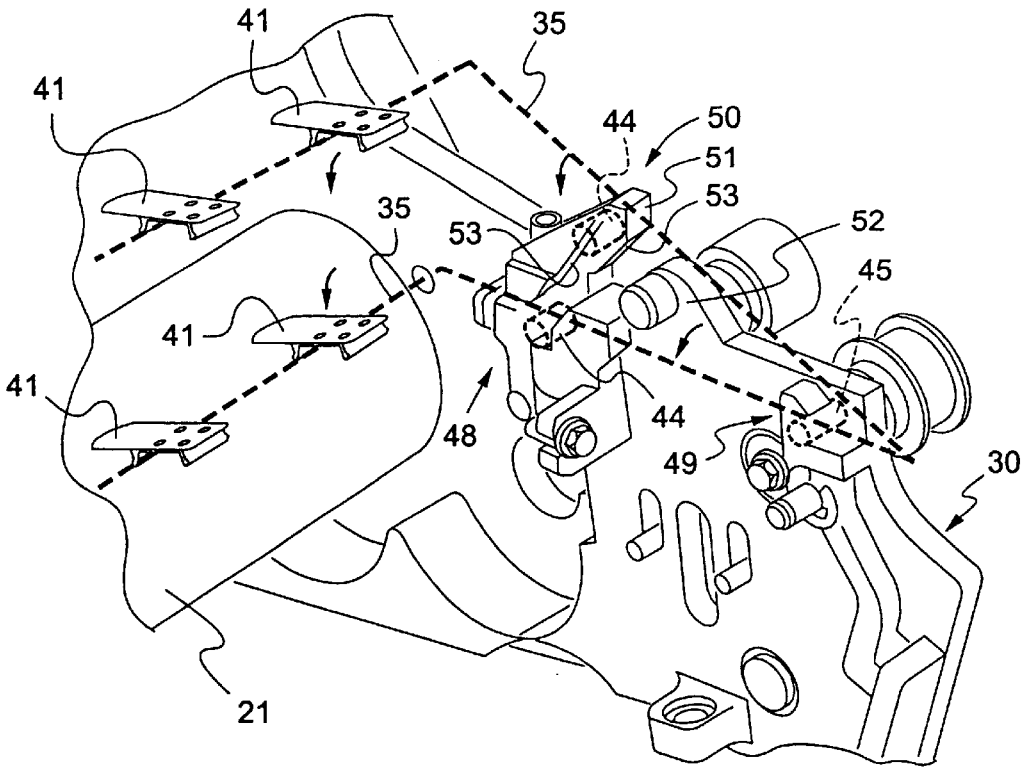
FIG. 5 is a perspective, enlarged view of one end of the latching assembly of FIG. 4, partly broken away, illustrating the positioning of the lower skive plate, shown in dotted lines, in an initial installation position and a final installed position.
Figure 6:
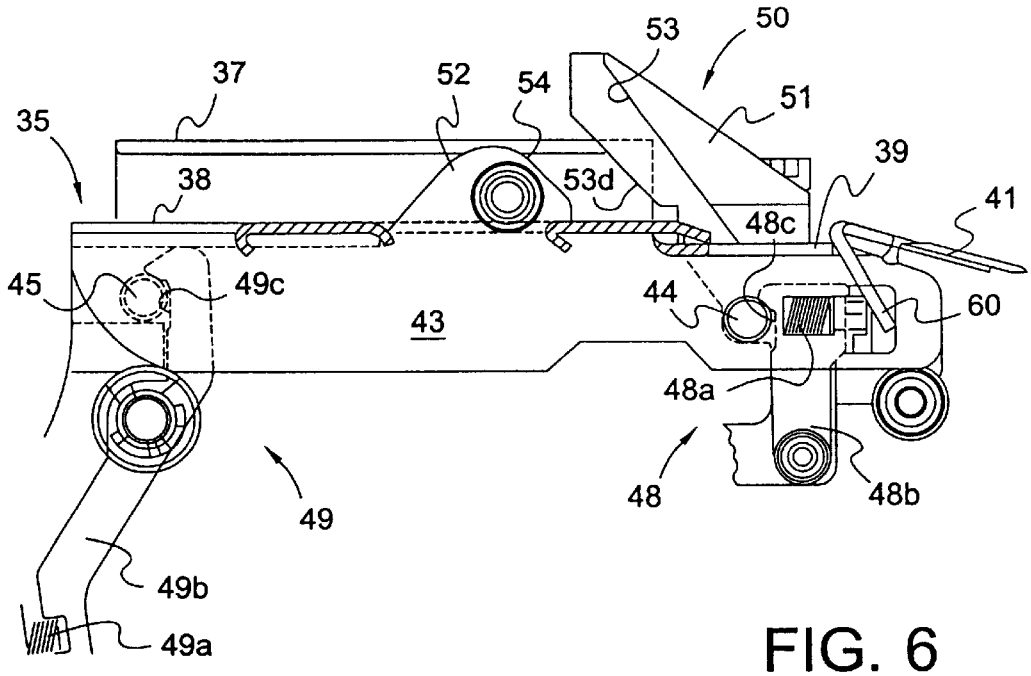
FIG. 6 is an enlarged, sectional view, partly broken away, of the latching assembly of the present invention with the lower skive plate of FIG. 3 in a latched, operable position.

The mechanism for releasably securing lower skive plate 35 in its proper position within housing 30 is best seen in FIGS. 5 and 6. This mechanism is comprised of a pair of forward detents 48 (one on each side of housing 30) and a matching pair of rear detents 49. Since both sides of the latching mechanism is basically a mirror-image of the other, only the components on one side will be described in detail. Forward detent 48 is comprised of a pivoted arm 48*b* having a recess 48*c* near its upper end and rear detent 49 is comprised of a pivoted arm 49*b* having a multi-angled recess 49*c* near its upper end which are normally biased toward their latched positions by springs 48*a*, 49*a*, respectively.

Secured to housing 30 adjacent the forward detent 49 is guide assembly 50 which, in turn, is comprised a forward guide element 51 and a spaced, rearward guide element 52. Forward element 51 has a first guide surface (i.e. slot defining a track 53) which is precisely angled (e.g. 45°) to guide and direct forward latch pin 44 into forward detent 48 during the installation of the skive plate. Forward guide element 51 also has a second, angled guide surface 53*a* for a purpose described below. Rearward guide element 52 has a guide surface or ramp 54 thereon which cooperates with second guide surface 53*a* as will be more fully discussed below.

In installing lower skive plate 35, it is extremely important that the plate not be tipped towards the fuser roller 22 and thereby risk that the sharp skives 41 come into contact with the roller. To prevent this from happening in the present invention, an angled tab 60 (FIG. 6) is provided on the underside of plate 35 which contacts the decurler roller 40 (FIG. 4) during the initial stages of installation.

To install lower skive plate 35 into housing 30, the plate is positioned onto the tops of the forward elements 51 of vertical guides 50 and is moved forward. It is desirable to keep the plate as horizontal as possible during installation to protect the rollers from the skives. As the openings 46 in handles 37 align with their respective rearward guide elements 52, the plate 35 will drop whereupon forward pins 44 will enter the upper end of the tracks 53 in forward guide elements 51 thereby guiding the tips of skives 41 downward at a 45 degree angle onto fuser roller 21.

The inner surface of openings 46 on handles 37 contacts the ramps 54 on respective rearward elements 52 while the forward edges of the handles ride along second guide surfaces 53*a* on element 51, thereby requiring the technician to keep the rear of the skive plate low and substantially parallel to the frame 30 as he installs the plate. At this point, it is important that the rear of plate 35 be low enough so that the rear pins 44 can be captured by rear detents 48 before the forward pins 45 are latched in place within detents 49. Again, the contact between the plate 35 and ramps 54 and guide surfaces 53*a* require the technician to lower the rear of plate 35 towards rear detents 48 before the front pins can be captured by forward detents 49.

The angled underside of recess 49*c* provides a lead into the recess but is flat enough to engage the top of pin 45 in much the same way as a flat surface of a stationary slot would, thereby preventing the detents 49 from being unlatched by accidentally lifting the rear of plate 35. The detents 49 are relatively short so that rear pins 45 can be lowered into recesses 49*c* near the end of the installation operation without binding the pins. After the rear pins 45 are securely latched by rear detents 49, the lowering of the front of the plate 35 is continued until forward pins 44 are latched within detents 48 and the installation of skive plate 35 is complete.

To remove lower skive plate 35, the above procedure is reversed. The front of plate 35 is raised to cam pins 44 out of the recesses 48*c* of forward detents 48 thereby unlatching the front of plate 35 from housing 30. Plate 35 is then move rearward away from fuser roller 21. To insure that the front of the plate 35 is unlatched and that pins 44 has been lifted out of forward detents 48 before the rear pins 45 are unlatched, the underside of recess 49*c* is of an angle which makes this difficult. Further, the travel of rear detent 49 is limited so that rear pin 45 cannot clear recess 49*c* when detent 49 is "bottomed-out" against stop 66 (FIG. 6) until front pins 44 are unlatched and plate 35 is moved rearward.

What is claimed is:

1. A fuser section for an electrophotographic apparatus, said fuser section comprising:

a housing having two sides;

a fuser roller rotatably mounted in said housing;

a skive plate comprising;

a base plate having a front, rear, and two sides;

a plurality of skives mounted on and spaced across said front of said base plate, said skives positioned to ride on said fuser roller when said skive plate is in its operable position within said housing to thereby strip a sheet of paper off said fuser roller as said sheet passes over said fuser roller; and a forward latch pin and a rear latch pin mounted on each of said two sides of said base plate;

a guide assembly on said housing for guiding said skive plate to its operable position within said housing while preventing said skives from contacting and damaging said fuser roller during installation; and a latching mechanism on said housing for releasably latching said forward and rear latch pins to said housing when said skive plate is in its operable position within said housing.

2. The fuser section of claim 1 wherein said latching mechanism comprises:

a forward releasable latch on each of said two sides of said housing and adapted to receive respective, said forward latch pins on said skive plate; and a rear releasable latch on each of said two sides of said housing and spaced from said respective, forward releasable latches and adapted to receive respective, said rear latch pins on said skive plate.

3. The fuser section of claim 2 wherein said forward releasable latch comprises:

a first arm pivotably mounted on said housing having a recess near its upper end adapted to receive said forward latch pin on said skive plate when said skive plate is in its operable position within said housing; and a spring normally biasing said first arm toward its latched position;

and wherein said rear releasable latch comprises:

a second arm pivotably mounted in said housing and having a recess adapted to receive said rear latch pin on said skive plate when said skive plate is in its operable position within said housing; and a spring normally biasing said second arm toward its latched position.

4. The fuser section of claim 3 wherein said guide assembly comprises:

a forward guide element positioned on each of said two sides of said housing adjacent said fuser roller, said forward element having a track therein adapted to guide said forward latch pin downward towards said fuser roller as said skive plate is being installed; and a rear guide element positioned on each of said two sides of said housing and spaced from its respective said forward guide element.

5. The fuser section of claim 4 wherein said track in said forward element is inclined at an acute angle with respect to the vertical.

6. The fuser section of claim 5 wherein said angle is about 45°.

7. The fuser section of claim 5 including a cooling grill positioned within said housing downstream and adjacent said fuser roller; and wherein said skive plate having a recess across a portion of said rear of said base plate, said recess adapted to lie over said cooling grill when said skive plate is in its operable position within said housing to thereby allow air from said cooling grill to flow through said base plate to cool said sheet of paper as said paper passes over said base plate.

8. A skive plate for stripping a sheet of paper off a roller in a fuser section of an electrophotographic apparatus, said skive plate comprising:

a base plate having a front, rear, and two sides;

a plurality of skives mounted on and spaced across said front of said base plate, said skives positioned to ride on said roller when said skive plate is in its operable position within said fuser section; and a forward latch pin mounted on and extending from each of said two sides of said base plate, said forward latch pin being adapted to be received by a respective, forward latching detent in said fuser section;

a rear latch pin mounted on and extending from each of said two sides of said base plate; said rear latch pin being spaced from said forward latch pin and being adapted to be received by a respective, rear latching detent in said fuser section; and a recess extending across a portion of said rear of said base plate and adapted to lie over a cooling grill when said skive plate is in its operable position within said housing.

9. The skive plate of claim 8 including:

a tab extending downward from the underside of said front of said base plate, said tab adapted to engage a decurler roller in said fuser section to prevent said skives from contacting said fuser roller during installation.

10. A method for installing a skive plate into the fuser section of an electrophotographic apparatus wherein said fuser section has a fuser roller mounted therein, said skive plate having a plurality of skives and forward and rear latch pins thereon, said method comprising:

positioning said forward latch pins into respective guide tracks provided on said fuser section;

moving said skive plate forward toward said fuser roller to move said forward latch pins forward and downward in said guide tracks while maintaining said skive plate in a relative horizontal position thereby maintaining said skives clear of said fuser roller as said plate is being moved toward its operable position within said fuser section;

latching said rear latch pins on said skive plate in said fuser section before latching said forward latch pins, and latching said rear latch pins on said skive plate in said fuser section thereby releasably securing said skive plate in said fuser section with said skives riding on said fuser roller.

11. The method of claim 10 wherein said forward latch pins are moved forward and downward in said guide tracks at an angle of about 45°.

12. The method of claim 11 wherein said skives are maintained out of contact with said fuser roller until said rear latch pins have been latched to said fuser section.

13. The method of claim 12 including removing said skive plate from said fuser section which, in turn, includes:

unlatching said front latch pins from said fuser section and lifting said skives up and away from said fuser roller;

unlatching said rear latch pins from said fuser section and moving said skive plate upward while maintaining said skive plate in a substantial horizontal position to remove said skive plate from said fuser section.

* * * * *